US011022266B2

(12) United States Patent
Hermitte et al.

(10) Patent No.: US 11,022,266 B2
(45) Date of Patent: Jun. 1, 2021

(54) LUMINOUS DEVICE IMAGING THE LIT SURFACES OF AT LEAST TWO COLLECTORS

(71) Applicant: VALEO VISION SAS, Bobigny (FR)

(72) Inventors: Michel Hermitte, Bobigny (FR); Sylvain Giraud, Bobigny (FR)

(73) Assignee: Valeo Vision, Bobigny (FR)

( * ) Notice: Subject to any disclaimer, the term of this patent is extended or adjusted under 35 U.S.C. 154(b) by 0 days.

(21) Appl. No.: 15/931,974

(22) Filed: May 14, 2020

(65) Prior Publication Data

US 2021/0010653 A1 Jan. 14, 2021

(51) Int. Cl.

| | |
|---|---|
| ***F21S 41/148*** | (2018.01) |
| ***F21S 41/33*** | (2018.01) |
| ***F21S 41/25*** | (2018.01) |

(52) U.S. Cl.

CPC ..... *F21S 41/331* (2018.01); *F21S 41/148* (2018.01); *F21S 41/25* (2018.01)

(58) Field of Classification Search

CPC ..... F21S 41/147; F21S 41/148; F21S 41/331
See application file for complete search history.

(56) References Cited

U.S. PATENT DOCUMENTS

| | | | | |
|---|---|---|---|---|
| 7,311,430 | B2 * | 12/2007 | Tsukamoto | F21S 41/155 362/545 |
| 7,993,043 | B2 * | 8/2011 | Sazuka | F21S 41/148 362/509 |
| 10,166,910 | B2 | 1/2019 | Meyrenaud et al. | |
| 10,174,900 | B2 | 1/2019 | Schone | |
| 2011/0170310 | A1 | 7/2011 | Haenen et al. | |

FOREIGN PATENT DOCUMENTS

| | | | |
|---|---|---|---|
| EP | 1500869 | A1 | 1/2005 |
| EP | 2182272 | A1 | 5/2010 |
| EP | 2565530 | A1 | 3/2013 |
| FR | 3038695 | A1 | 1/2017 |
| FR | 3047541 | A1 | 8/2017 |
| JP | 2011100583 | A | 5/2011 |
| JP | 201716784 | A | 1/2017 |

OTHER PUBLICATIONS

French Republic National Institute of Industrial Property, Preliminary Search Report for related French application No. FR1902618, dated Jan. 23, 2020.

* cited by examiner

*Primary Examiner* — Robert J May
(74) *Attorney, Agent, or Firm* — Valeo Vision

(57) ABSTRACT

The invention relates to a luminous device, particularly applicable to a motor vehicle, comprising a first light source and a second light source that each emit light rays; a first collector and a second collector each include a reflective surface configured to collect and reflect the light rays emitted by the first light source and the second light source, respectively, into a first light beam and a second light beam; an optical system configured to project the first light beam and second light beam along an optical axis of the device; the optical system is configured to form a luminous image of each reflective surface of the first collector and second collector.

14 Claims, 5 Drawing Sheets

[Fig 1]
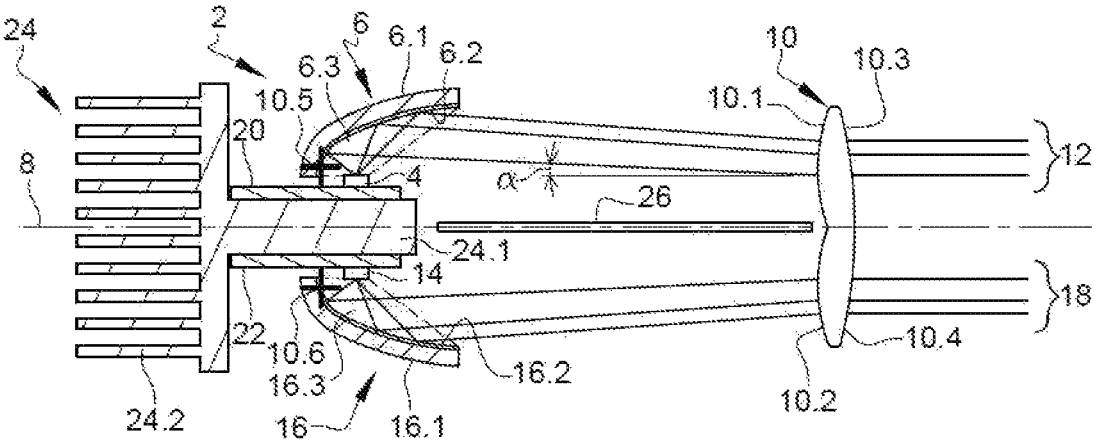
[Fig 2]
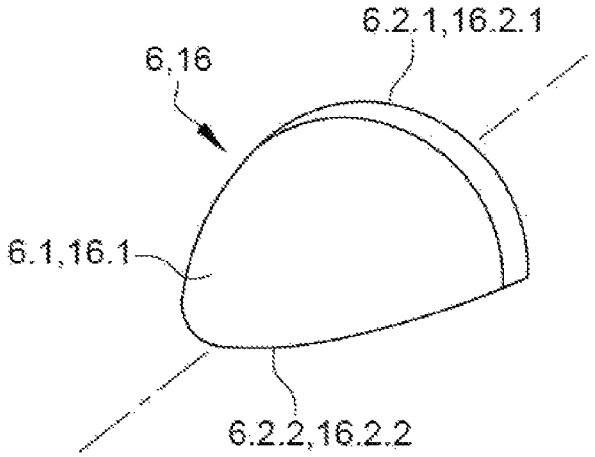
[Fig 3]
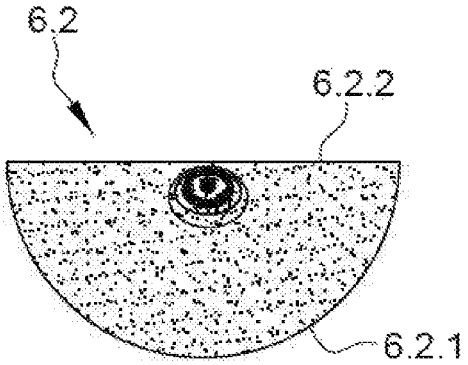

[Fig 4]
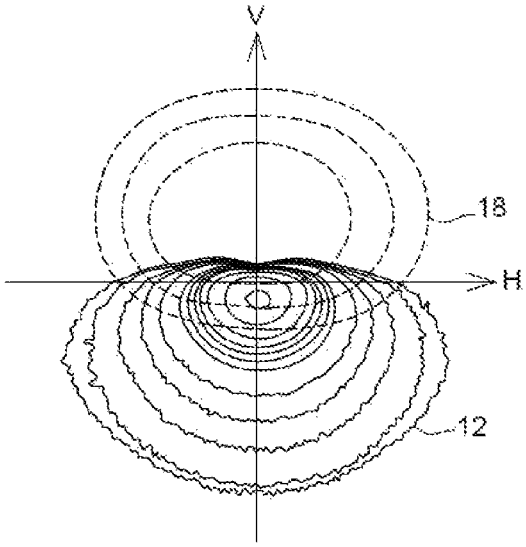
[Fig 5]
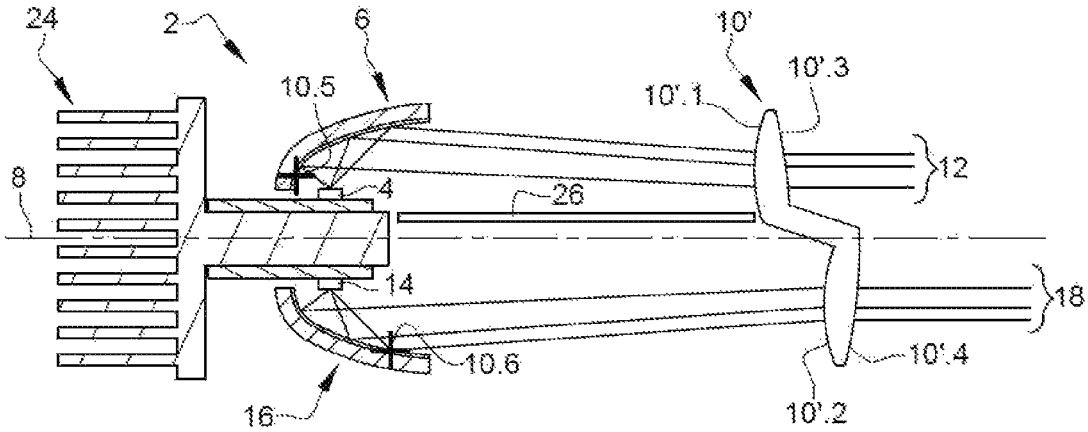

[Fig 6]
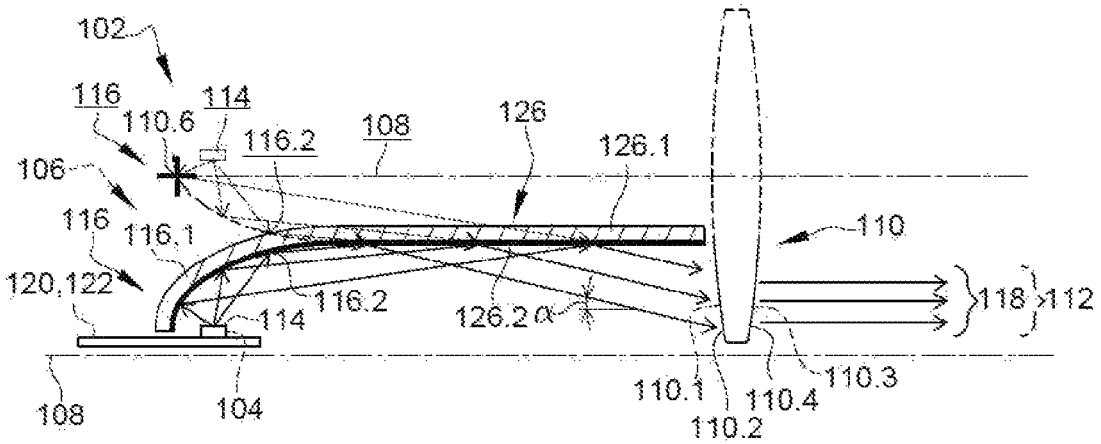
[Fig 7]
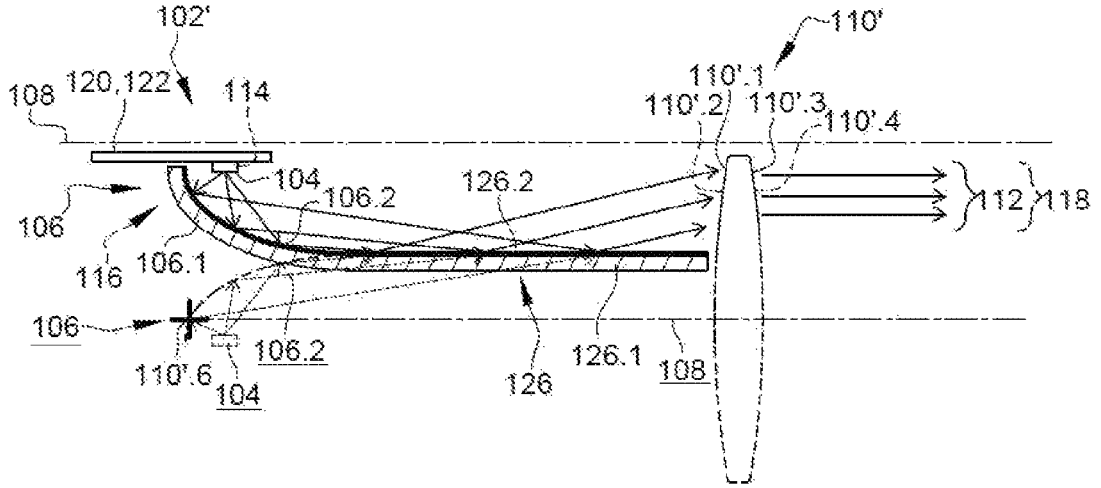

[Fig 8]
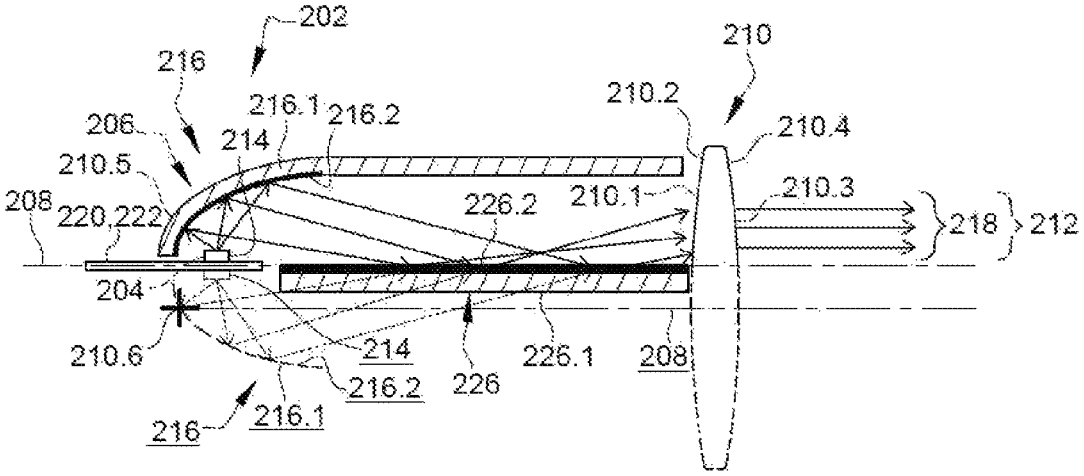
[Fig 9]
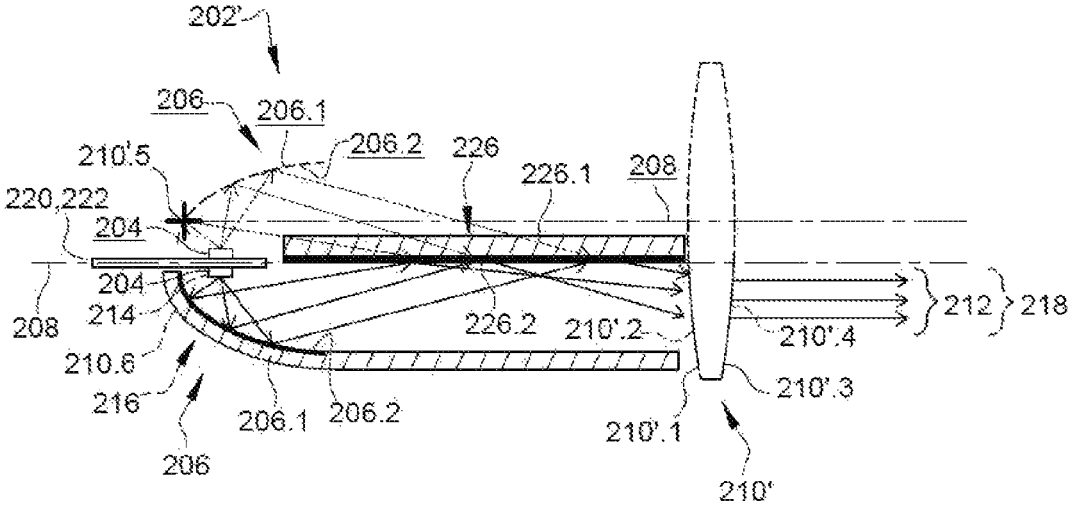
[Fig 10]
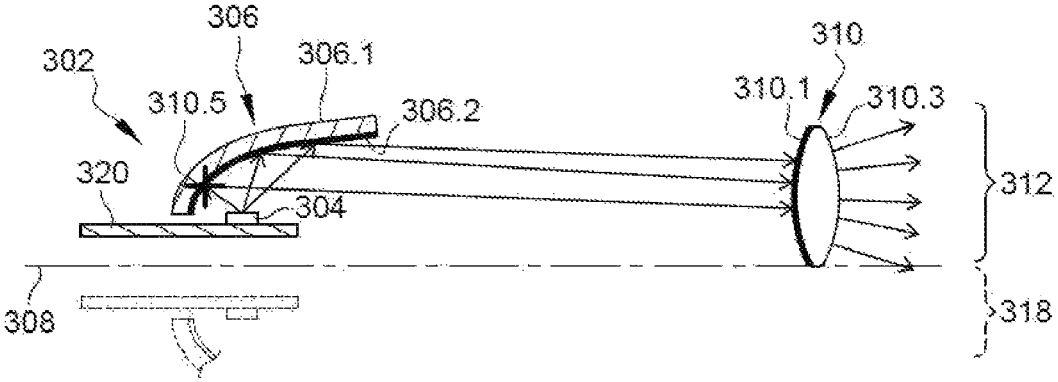

[Fig 11]
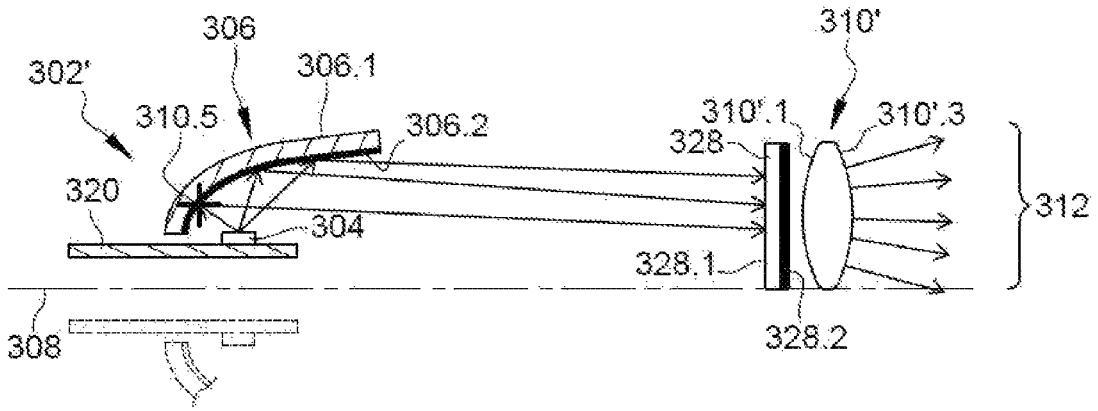
[Fig 12]
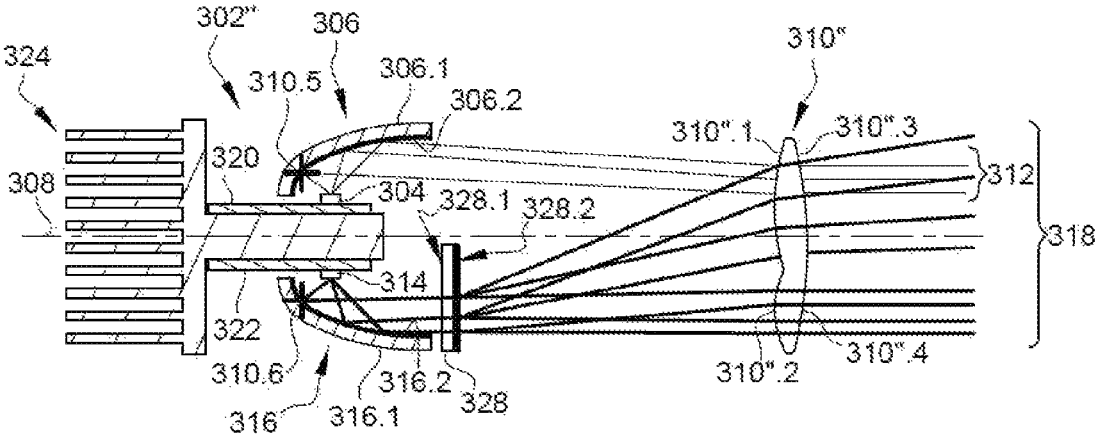

LUMINOUS DEVICE IMAGING THE LIT SURFACES OF AT LEAST TWO COLLECTORS

CROSS-REFERENCE TO RELATED APPLICATIONS

This application claims the benefit of French application Serial No. 1902618 filed Mar. 14, 2019, the disclosure of which is hereby incorporated in its entirety by reference herein.

TECHNICAL FIELD

The invention relates to the field of luminous lighting and signaling field, and more particularly to the motor vehicle.

BACKGROUND

Published patent document FR 3 047 541 A1 discloses a lighting device comprising two optical modules placed on opposing sides. Each of these two optical modules essentially comprises a light source and a collector with a reflective surface. These two light sources are placed on two opposite faces of a common carrier. Each of the reflective surfaces is a surface of revolution in a half-space bounded by the common carrier of the light sources. The two reflective surfaces thus form two half-shells opposite each other. One of the two optical modules is configured to form a lighting beam containing a flat cut-off, corresponding to a so-called low beam. To do this, the device comprises a reflective surface with an edge referred to as the "cut-off" edge, said edge being located at a focal point of the reflective surface. The rays that encounter the surface in question behind the cut-off edge are reflected toward an upper portion of a projecting lens whereas those that pass in front of the edge in question are not deviated and encounter a lower portion of the lens in-question. This effect ensures an essentially flat cut-off of the beam. The other of the two optical modules essentially works in the same way, with the sole exception that the focal point of the reflective surface is located in front of the cut-off edge. The beam produced by the second optical module is combined with that of the first system to produce a high beam, i.e. a beam without a flat cut-off. This configuration is advantageous in that it exploits the cut-off-containing beam to produce a high beam.

Such a luminous device has the drawback of requiring a high precision in the positioning of the deflector and of the cut-off edge. Thus, the projecting lens must be a thick lens because of its small focal length, which has the effect of increasing its weight and complicating the production thereof. In particular, with regard to sink marks. In addition, the collector has a certain height. Thus, has a certain heightwise bulk.

SUMMARY

The objective of the invention is to mitigate at least one of the drawbacks of the aforementioned prior art. More particularly, the objective of the invention is to provide a luminous device that is able to perform a plurality of lighting and/or signaling functions that is compact and that is more economical to produce.

The subject of the invention is a luminous device, in particular for a motor vehicle, comprising: a first light source and a second light source that are each able to emit light rays; a first collector and a second collector each with a reflective surface configured to collect and reflect the light rays emitted by the first light source and the second light source, respectively; an optical system configured to project the rays reflected by the reflective surfaces of the first collector and of the second collector, respectively, into a first light beam and a second light beam along an optical axis of the device; noteworthy in that the optical system is configured to form a luminous image of the reflective surface of each of the first collector and second collector, and each of the first light beam and second light beam forms a portion or the entirety of a lighting or signaling function that is distinct from the lighting or signaling function of the other of said first and second beams.

The luminous device forms a stand-alone assembly in that each of the components thereof, such as for example the light sources, the collectors and the optical system, is rigidly fastened to the other components, in particular via a specific carrier (not detailed), and is thus optically positioned with respect to the other components. One or more luminous devices may thus be placed in a headlamp casing in order to perform, where appropriate in combination, all the required regulatory lighting and signaling functions.

Advantageously, the first collector and the first light source are placed, with respect to the second collector and to the second light source, so that the luminous image of the reflective surface of the first collector is inverted, with respect to the optical axis, versus the luminous image of the reflective surface of the second collector.

According to one advantageous embodiment of the invention, at least one of the first collector and second collector is configured so that the light rays reflected by a rear portion of the reflective surface of said collector are parallel to the optical axis or have, in a vertical plane with respect to said axis, an angle of inclination smaller than or equal to 25°, and preferably an angle of inclination smaller than or equal to 10°.

According to one advantageous embodiment of the invention, the first light source and second light source are configured to emit in a main direction that is perpendicular to the optical axis or that is inclined with respect to a direction perpendicular to said optical axis by an angle smaller than or equal to 25°. Advantageously, the reflective surfaces of the first collector and second collector have an elliptical or parabolic profile. Preferably, it is a surface of revolution of said profile. The revolution is about an axis that advantageously is parallel to the optical axis. According to one variant, the reflective surface is a free-form surface or a swept surface or an asymmetric surface. It may also comprise a plurality of segments.

According to one advantageous embodiment of the invention, the optical system has a first focal point located axially behind a front limit of the reflective surface of the first collector, and/or a second focal point located axially behind a front limit of the reflective surface of the second collector.

According to one advantageous embodiment of the invention, the optical system is a lens with a first entrance face for the first light beam and a second entrance face for the second light beam.

According to one advantageous embodiment of the invention, the first and second entrance faces are aligned perpendicular to the optical axis.

According to one advantageous embodiment of the invention, the lens has an exit face common to the first and second entrance faces.

According to one advantageous embodiment of the invention, the first collector and the first light source are opposite, with respect to the optical axis, to the second collector and to the second light source, respectively; or the first collector and the first light source, on the one hand, and the second collector and the second light source, on the other hand, are placed side-by-side.

According to one advantageous embodiment of the invention, the reflective surface of at least one of the first collector and second collector is concave and has, with respect to a general direction of propagation of the corresponding light beam, a front edge and a rear edge, said edges bounding in opposite directions the corresponding luminous image.

According to one advantageous embodiment of the invention, the first collector and the first light source are located above the optical axis when the device is oriented in functional position, the first beam being a lighting beam containing an upper flat cut-off formed by the rear edge of the reflective surface of the first collector.

According to one advantageous embodiment of the invention, said luminous device furthermore comprises a mirror configured to form a virtual image of at least one of the first and second light sources and of the reflective surface of the corresponding first collector and/or second collector.

According to one advantageous embodiment of the invention, the mirror lies in the extension of the reflective surface of the corresponding collector, or the mirror lies on the optical axis.

According to one advantageous embodiment of the invention, the first collector and the first light source are located below the optical axis when the device is oriented in functional position, the first beam being a lighting beam containing an upper flat cut-off formed by the rear edge of the reflective surface of the first collector.

According to one advantageous embodiment of the invention, the second collector and the second light source are located above the optical axis when the device is oriented in functional position, the second beam being a lighting beam with an upper portion without flat cut-off, formed by a front portion of the reflective surface of the second collector.

According to one advantageous embodiment of the invention, the first light beam is a lighting beam with or without an upper flat cut-off and the second beam is a signaling beam, the optical system comprising a grained dioptric interface configured to scatter the second light beam.

According to one advantageous embodiment of the invention, the grained dioptric interface is formed on the second entrance face.

According to one advantageous embodiment of the invention, the lens is a main lens, the optical system comprising an intermediate lens with the grained dioptric interface, said lens being placed optically between the reflective surface of the second collector and the main lens.

According to one advantageous embodiment of the invention, the first light source and the second light source are placed on a common platen.

The measures of the invention are advantageous in that they allow all or some of a plurality of distinct lighting or signaling functions to be performed with the same device having the advantages of compactness and of ease of assembly in that the precision required to align the various components is lower than in the prior art. More particularly, producing an image of each of the illuminated reflective surfaces is advantageous on account of the fact that these images contain a concentration of light in proximity to the rear edge of these reflective surfaces, thus allowing the light to be concentrated on the flat axis.

Other features and advantages of the present invention will be better understood by virtue of the description and the drawings.

BRIEF DESCRIPTION OF THE DRAWINGS

FIG. 1 is a schematic representation of a luminous device according to a first embodiment of the invention.

FIG. 2 is a perspective view of the upper collector of the luminous device of FIG. 1.

FIG. 3 is a view of the lit interior surface of the collector of the luminous device of FIG. 1, from the exterior along the optical axis.

FIG. 4 is a graphical representation of the luminous images of the lighting beams produced by the luminous device of FIG. 1.

FIG. 5 is a schematic representation of one variant of the luminous device according to the first embodiment of the invention.

FIG. 6 is a schematic representation of a luminous device according to a second embodiment of the invention.

FIG. 7 is a schematic representation of one variant of the luminous device according to the second embodiment of the invention.

FIG. 8 is a schematic representation of a luminous device according to a third embodiment of the invention.

FIG. 9 is a schematic representation of one variant of the luminous device according to the third embodiment of the invention.

FIG. 10 is a schematic representation of a luminous device according to a fourth embodiment of the invention.

FIG. 11 is a schematic representation of a first variant of the luminous device according to the fourth embodiment of the invention.

FIG. 12 is a schematic representation of a second variant of the luminous device according to the fourth embodiment of the invention.

DETAILED DESCRIPTION

In the following description the notions of "above" and "below" the optical axis are to be understood with respect to the luminous device when it is in functional position, i.e. with an orientation that corresponds to that for which it was designed. Similarly, the notions "front" and "rear" are to be understood with respect to the general direction of the light, along the optical axis of the luminous device, when the luminous device is in functional position.

FIGS. 1 to 4 illustrate a first embodiment of a luminous device according to the invention.

FIG. 1 is a schematic representation of the luminous device and of its operating principle. The luminous device 2 essentially comprises a first light source 4, a first collector 6 able to reflect the light rays emitted by the first light source in order to form a first light beam 12 along an optical axis 8 of the device, and a lens 10 for projecting said beam. Projecting optical systems other than the projecting lens are envisionable, such as in particular one or more mirrors. The luminous device 2 furthermore comprises a second light source 14 that is opposite, with respect to the optical axis 8, to the first light source 4 and a second collector 16 that is also opposite to the first collector 6 and that is able to reflect the light rays emitted by the second light source 14 in order to form a second light beam 18 along the optical axis 8 of the device.

The light sources 4 and 14 are advantageously semiconductor light sources, and in particular light-emitting diodes. Each of the light sources 4 and 14 emits light rays in a half-space bounded by the main plane of said source, in the shown example in a main direction perpendicular to said plane and to the optical axis 8. According to the invention, the main direction of emission will possibly be inclined with respect to a direction perpendicular to the optical axis by an angle smaller than or equal to 25°.

Each of the collectors 6 and 16 comprises a carrier 6.1 and 16.1, of shell or cap shape, and a reflective surface 6.2 and 16.2 on the interior face of the carrier 6.1 and 16.1. The reflective surfaces 6.2 and 16.2 advantageously have an elliptical or parabolic profile. At least one thereof is advantageously a surface of revolution about an axis parallel to the optical axis. Alternatively, it may be a question of a free-form surface or a swept surface or an asymmetric surface. It may also comprise a plurality of segments. The shell- or cap-shaped collectors 6 and 16 are advantageously made from materials having a good heat resistance, for example of glass or of synthetic polymers such as polycarbonate PC or polyetherimide PEI. The expression "parabolic" generally applies to reflectors the surface of which has a single focal point, i.e. one region of convergence of the light rays, i.e. one region such that the light rays emitted by a light source placed in this region of convergence are projected to great distance after reflection from the surface. Projected to great distance means that these light rays do not converge toward a region located at at least 10 times the dimensions of the reflector. In other words, the reflected rays do not converge towards a region of convergence or, if they converge, this region of convergence is located at a distance larger than or equal to 10 times the dimensions of the reflector. A parabolic surface may therefore comprise or not comprise parabolic segments. A reflector having such a surface is generally used alone to create a light beam. Alternatively, it may be used as projecting surface associated with an elliptical reflector. In this case, the light source of the parabolic reflector is the region of convergence of the rays reflected by the elliptical reflector.

Each of the light sources 4 and 14 is placed at a focal point of the corresponding reflective surface 6.2 and 16.2 so that the rays thereof are collected and reflected along the optical axis 8. At least some of these reflected rays have angles of inclination a, in a vertical plane, with respect to said axis, that are smaller than or equal to 25°, and preferably smaller than or equal to 10°, so as to be under so-called Gaussian conditions, allowing a stigmatism, i.e. a clearness of the projected image, to be obtained. It is advantageously a question of the rays reflected by the rear portion of the reflective surface 6.2 and 16.2.

The projecting lens 10 has a first entrance face 10.1 for the light rays corresponding to the first light beam 12, a second entrance face 10.2 for the light rays corresponding to the second light beam 18, a first exit face 10.3 for the first light beam 12 and a second exit face 10.4 for the second light beam 18. The first and second exit faces 10.3 and 10.4 advantageously form an exit face common to the two entrance faces 10.1 and 10.2. The lens 10 is said to be thin, for example with a thickness, along the optical axis of the device, that is smaller than 7 mm, in particular because of the small lens height and the long focal length thereof. The lens 10 may have a first focal point 10.5 and a second focal point 10.6, the first focal point 10.5 corresponding to the upper portion of the lens 10 and the second focal point 10.6 corresponding to the lower portion of the lens 10. Each of the first and second focal points 10.5 and 10.6 in question is advantageously located in a region 6.3/16.3 located between the reflective surface 6.2/16.2 of the corresponding first or second collector 6/16 and the corresponding first or second light source 4/14 (these regions have been shown with dashed lines). In the present case, at least one of the focal points may be located on the reflective surface 6.2/16.2 of the corresponding first or second collector 6/16. It will be noted that it is also possible for this focal point to be located behind or in front of the reflective surface 6.2/16.2 provided that it is in proximity, and preferably within less than 10 mm, and preferably less than 5 mm, thereto.

The reflective surface, if it is elliptical, has a second focal point located in front of the lens 10 and at distance from the optical axis 8. It will be noted that it is also possible for this focal point to be located behind the lens and/or on the optical axis, provided that it is in proximity to the lens, so as to decrease the width of the beam on the entrance face of the lens.

Again with reference to FIG. 1, it may be seen that the first light source 4 and the first collector 6, on the one hand, and the second light source 14 and the second collector 16, on the other hand, are opposite with respect to the optical axis 8. In particular, the first light source 4 is placed on a first platen 20 and the second light source 14 is placed on a second platen 22 that is separate and distant from the first platen 20. A heat sink 24 is thermally coupled to the first and second light sources 4 and 16 via a segment 24.1 that serves as carrier for the first and second platens 20 and 22. The heat sink 24 also comprises a dissipating portion 24.2 with cooling fins. This arrangement is particularly advantageous from a thermal point of view. It will however be understood that it is also possible for the first and second light sources to be placed on opposite faces of a common platen.

The luminous device advantageously comprises an absorbing screen 26 that lies on the optical axis 8, which is located between the first and second collectors 6 and 16 and the lens 10, so as to absorb any light rays that encounter it and thus prevent parasitic reflections.

Again with reference to FIG. 1, the first light beam 12 is advantageously a lighting beam containing an upper flat cut-off (i.e. a low beam) and the second light beam 18 is advantageously a lighting beam without cut-off I (i.e., in combination with the first light beam 12, a high beam).

FIG. 2 is a rear view, in perspective, of one of the first and second collectors 6 and 16 of the luminous device 2 of FIG. 1, however oriented like the first collector. The shell or cap shape of the carrier 6.1/16.1 and the fact that the reflective surface (not shown) has a front edge 6.2.1/16.2.1 and a rear edge 6.2.2/16.2.2 may be seen. On account of the fact that the carrier 6.1/16.1 and, therefore, the reflective surface 6.2/16.2 forms a preferably symmetric shell of revolution bounded by a plane, the plane in question comprises the rear edge 6.2.2/16.2.2. The latter lies in this plane laterally on either side of the axis of revolution. When the reflective surface 6.2/16.2 is lit by the light source, the entirety of the surface thereof is then illuminated, said surface being bounded by the front edge 6.2.1/16.2.1 and rear edge 6.2.2/16.2.2.

FIG. 3 is a representation of the light intensity on the reflective surface 6.2 of the first collector seen from the exterior, along the optical axis. More specifically, it is a question of the irradiance of the surface, namely the power per unit area of the electromagnetic radiation incident perpendicular to the direction of said surface, expressed in W/m2. The dark zone covering most of the surface corresponds to lower irradiances whereas the lighter central zone corresponds to higher irradiances. It may be seen that the dark zone is clearly bounded by the edges 6.2.1 and 6.2.2. In other words, the lit surface 6.2 naturally has clear edges able to form cut-offs in the projected lighting beam imaging this surface. The same reasoning applies to the second collector, the only difference being that the light-intensity distribution is rotated by 180° about the optical axis.

FIG. 4 is a graphical representation of the images projected by the luminous device of FIG. 1. The horizontal axis H and the vertical axis V cross on the optical axis of the luminous device. The solid lines correspond to the first light beam 12 and the dashed lines correspond to the second light beam 18. These curves are isolux curves, i.e. curves corresponding to regions of the light beam in which the luminance expressed in lux is the same. The curves at the center correspond to a higher luminance level than on the periphery.

It may be seen in FIG. 4 that the first light beam 12 contains an upper flat cut-off essentially level with the horizontal axis H. The cut-off is not perfectly straight; it has a curvature that corresponds to aberrations in the image thus produced. In any case, the flat cut-off is produced by the edge 6.2.2 (FIG. 3), which is the rear edge (FIG. 2) of the reflective surface 6.2 of the first collector 6. To this end, the first focal point 10.5 of the lens 10 (FIG. 1) is advantageously located in proximity to this edge 6.2.2 (FIG. 3), i.e. behind the first light source 4. It may also be seen that the produced light beam has, under the horizontal axis, a clear outline corresponding to the front edge 6.2.1.

Again in FIG. 4, it may be seen that the second light beam 18 essentially corresponds to an upside-down or inverted version of the first light beam 12 and concentrates the light on the horizontal axis H and above said axis so as to complete the first light beam 12. This concentration of light in the top portion of the second beam is achieved via the portion of the reflective surface 16.2 that is in proximity to the rear edge 16.2.2. To this end, the second focal point 10.6 of the lens 10 (FIG. 1) may be located in proximity to the rear edge 16.2.2 (FIG. 2).

FIG. 5 is a schematic representation of one variant of the luminous device 2 of the first embodiment of the invention, i.e. the embodiment illustrated in FIG. 1. This variant differs from FIG. 1 in that the lens 10' no longer has a common exit face but rather distinct exit faces. In the present case, it may be seen that the second entrance face 10'.2 and the second exit face 10'.4 are offset axially with respect to the first entrance face 10'.1 and first exit face 10'.3. More particularly, this offset is such that the second entrance face 10'.2 and second exit face 10'.4 are further away from the first and second collectors 6 and 16 than the first entrance face 10'.1 and first exit face 10'.3. This in particular allows constraints on bulk to be met.

FIG. 6 is a schematic view of a luminous device according to a second embodiment of the invention. The reference numbers of the first embodiment have been used to designate corresponding or identical elements, these numbers however being increased by 100. Reference is moreover made to the description of these elements given in the context of the first embodiment. Specific numbers comprised between 100 and 200 are used to designate elements specific to this embodiment.

In this luminous device 102, the second light source 114 and the second collector 116 are no longer opposite, with respect to the optical axis of the device, to the first light source 104 and to the first collector 106, but instead are located beside the latter light source and collector. The first light source 104 and the first collector 106 are not visible because located behind the second light source 114 and the second collector 116. The luminous device 102 furthermore comprises a mirror 126 placed in the extension of the reflective surface 116.2 of the collector 116. The mirror 126 comprises a carrier 126.1 and a planar reflective surface 126.2 formed on the carrier 126.1. The latter may be merged with or adjacent to the carrier 116.1 of the collector 116. The light source 114 is placed at a focal point of the reflective surface 116.2 of the collector 116 so that the rays thereof are collected and reflected toward the mirror 126. The latter reflects, towards the projecting lens 110, a virtual image 116.2 of the reflective surface 116.2, a virtual image 116 of the second collector 116 and a virtual image 114 of the light source 114, these having been shown with dashed lines in FIG. 6. Similarly to the first embodiment, at least some of these rays reflected by the mirror 126 have angles of inclination a, in a vertical plane, and with respect to said axis, that are smaller than or equal to 25°, and preferably smaller than or equal to 10°, so as to be under so-called Gaussian conditions, allowing a stigmatism, i.e. a clearness of the projected image, to be obtained. It is advantageously a question of the rays reflected by the rear portion of the reflective surface 116.2 of the second collector 116.

The lens 110 then comprises two distinct portions for the first and second beams 112 and 118, these two portions being side-by-side and no longer on either side of the optical axis as in the first embodiment. The lens 110 then has a first entrance face 110.1 and a first exit face 110.3 for forming the first beam 112 and a second entrance face 110.2 and a second exit face 110.4 for forming the second beam 118. It will however be noted that the two exit faces 110.3 and 110.4 may form a common exit face as in FIG. 1 or even distinct and potentially axially offset exit faces as in FIG. 5.

It will also be noted that the second portion of the lens, namely the portion with the second entrance and exit faces 110.2 and 110.4, is advantageously biconvex and symmetric with respect to the virtual optical axis 108 (dash-dotted line) located above the optical axis 108. This portion of the lens has a focal point 110.6 located on this virtual axis and in proximity to a rear edge of the reflective surface of the virtual collector. This allows this portion of the lens 110 to image the lit surface of the second collector 116 similarly to the first embodiment of the invention.

The configuration that has just been described is advantageous in particular for applications having constraints on downward bulk.

FIG. 7 is a schematic representation of one variant of the luminous device 102 of the second embodiment of the invention, i.e. the embodiment illustrated in FIG. 6. The luminous device 102' according to this variant differs from FIG. 6 in that it is no longer the second light source 114 and the second collector 116 that are rotated about the optical axis 108 but rather the first light source 104 and the first collector 106. Similarly, the light source 104 is placed at a focal point of the reflective surface 106.2 of the first collector 106 so that the rays thereof are collected and reflected toward the mirror 126. The latter reflects, towards the projecting lens 110, a virtual image 106.2 of the reflective surface 106.2 of the first collector 106 and a virtual image 104 of the light source 104, these having been shown with dashed lines in FIG. 6. In other words, this inversion allows two opposite light beams (12 & 18) to be obtained from light sources that have the same orientation. The first light source 104 and the first collector 106 may thus, despite the rotation, produce a light beam similar to the first light beam 12 of the first embodiment, which is illustrated in FIG. 4, i.e. a beam with a concentration of light in the top portion thereof, which in the present case is level with the horizontal axis.

The first entrance and exit faces 110'.1 and 110'.3 of the lens 110' may be seen, but the second entrance and exit faces 110'.3 and 110'.4 have not been shown. The first portion of the lens 110' is then, similarly to the second portion of the lens of FIG. 6, advantageously biconvex and symmetric with respect to the virtual optical axis (dash-dotted line) located below the optical axis 108. This portion of the lens has a focal point 110'.6 located on this virtual axis and in proximity to a rear edge of the reflective surface of the virtual collector.

Similarly, the configuration that has just been described is advantageous in particular for applications having constraints on upward bulk.

FIG. 8 is a schematic view of a luminous device according to a third embodiment of the invention. The reference numbers of the first and second embodiments have been used to designate corresponding or identical elements, these numbers however being increased by 200 and 100, respectively. Reference is moreover made to the description of these elements given in the context of the first and second embodiments. Specific numbers comprised between 200 and 300 are used to designate elements specific to this embodiment.

This third embodiment is similar to the second embodiment (FIG. 6) in that in this luminous device 202, the second light source 214 and the second collector 216 are no longer opposite, with respect to the optical axis of the device, to the first light source 204 and to the first collector 206, but instead are located beside the latter light source and collector. The first light source 204 and the first collector 206 are not visible because located behind the second light source 214 and the second collector 216. The device 202 comprises a mirror 226 provided with a carrier 226.1 and with a reflective surface 226.2 that is advantageously planar. The mirror 226 and more particularly the reflective surface 226.2 lie on the optical axis 208. They are advantageously parallel to said axis, though it will however be understood that variants in which the latter are slightly inclined, for example by up to 20° or 10° of inclination, are envisioned. The reflective surface 216.2 of the second collector 216 is configured to reflect the rays emitted by the second light source 214 toward the reflective surface 226.2. The latter then reflects these rays to form a virtual image 214 of the second light source 214 and a virtual image 216.2 of the reflective surface 216.2 of the second collector 216, these virtual images (dashed lines) being located under the optical axis 208. In other words, the device 202 will produce an inverted luminous image of the lit surface of the second collector 216, corresponding to the virtual image 216 of the collector 216 (dashed line), and mainly located above the horizontal axis, while achieving a concentration of light in the bottom portion, level with said axis.

Similarly to the second embodiment, the lens 210 then comprises two distinct portions for the first and second beams 212 and 218, these two portions being side-by-side and no longer on either side of the optical axis as in the first embodiment. The lens 210 then has a first entrance face 210.1 and a first exit face 210.3 for forming the first beam 212 and a second entrance face 210.2 and a second exit face 210.4 for forming the second beam 218. It will however be noted that the two exit faces 210.3 and 210.4 may form a common exit face as in FIG. 1 or even distinct and potentially axially offset exit faces as in FIG. 5.

It will also be noted that the second portion of the lens, namely the portion with the second entrance and exit faces 210.2 and 210.4, is advantageously biconvex and symmetric with respect to the virtual optical axis (dash-dotted line) located under the optical axis 208. This portion of the lens has a focal point 210.6 located on this virtual axis 208 and in proximity to a rear edge of the reflective surface of the virtual collector. This allows this portion of the lens 210 to image the lit surface of the second collector 216 similarly to the first embodiment of the invention.

FIG. 9 is a schematic representation of one variant of the luminous device 202 of the third embodiment of the invention, i.e. the embodiment illustrated in FIG. 8. The luminous device 202' according to this variant differs from FIG. 8 in that it is no longer the second light source 214 and the second collector 216 that are rotated about the optical axis 208 but rather the first light source 204 and the first collector 206. Similarly, the reflective surface 206.2 of the first reflector is configured to reflect the light rays emitted by the first light source 204 toward the advantageously planar reflective surface 226.2 of the reflective screen 226. This reflective surface 206.2 then reflects the light rays toward the lens 210', and more exactly toward the first portion of the lens 210' corresponding to the first entrance and exit faces 210'.1 and 210'.3, thus causing an inversion of the luminous image, as though it were produced by the virtual collector 206 and the virtual light source 204 that have been drawn with dashed lines. In other words, this inversion allows the inversion caused by downward flip of the first light source 204 and of the first collector 206 to be cancelled out. Thus, the latter may produce a light beam similar to the first light beam 12 of the first embodiment despite the rotation, which is illustrated in FIG. 4, i.e. a beam with a concentration of light in the top portion thereof, which in the present case is level with the horizontal axis.

The first entrance and exit faces 210'.1 and 210'.3 of the lens 210' may be seen, but the second entrance and exit faces 210'.3 and 210'.4 have not been shown. The first portion of the lens 210' is then, similarly to the second portion of the lens of FIG. 8, advantageously biconvex and symmetric with respect to the virtual optical axis 208 (dash-dotted line) located above the optical axis 208. This portion of the lens has a focal point 210'.5 located on this virtual axis and in proximity to a rear edge of the reflective surface of the virtual collector.

Similarly, the configuration that has just been described is advantageous in particular for applications having constraints on upward bulk.

FIG. 10 is a schematic view of a luminous device according to a fourth embodiment of the invention. The reference numbers of the first embodiment have been used to designate corresponding or identical elements, these numbers however being increased by 300. Reference is moreover made to the description of these elements given in the context of the first embodiment. Specific numbers comprised between 300 and 400 are used to designate elements specific to this embodiment.

The luminous device 302 of FIG. 10 differs from the luminous device of the first embodiment in FIG. 1 essentially in that one of the light beams is a signaling light beam. Specifically, in the first embodiment the first and second light beams 12 and 18 are advantageously lighting beams, and in fact beams containing a flat cut-off (low-beam function) and no cut-off (high-beam function). In the case in FIG. 10, the first light beam 312 is a signaling light beam. To this end, a graining is provided on the first entrance face 310.1 of the lens. The first light source 304, the first collector 306 and the first portion of the lens 310, corresponding to the first entrance and exit faces 310.1 and 310.3, thus form a first diffuse light beam 312. The second light source, the second collector and the second portion of the lens are similar to those of one of the first, second and third embodiments. It will thus be understood that the second light beam may contain or not contain a cut-off and that the second light source and the second collector may be located above or below the optical axis 308.

FIG. 11 illustrates a first variant of the fourth embodiment of FIG. 10. The luminous device 302' according to this variant has a graining that, instead of being on the corresponding entrance face of the lens, is located on at least one of the entrance and exit faces 328.1 and 328.2 of an intermediate lens 328 located optically between the first collector 306 and the main lens 310. The light rays reflected by the reflective surface 306.1 of the first collector 306 pass through the intermediate lens before reaching the main lens 310. They are advantageously scattered through the dioptric interface formed by the grained exit face 328.2 of the intermediate lens.

FIG. 12 illustrates a second variant of the fourth embodiment of FIG. 10. The luminous device 302" according to this variant is illustrated completely, i.e. with, on one side of the optical axis 308, in the present case above the optical axis, the first light source 304 and the first collector 306, and on the other side of the optical axis, in the present case below the optical axis, the second light source 314 and the second collector 316. Similarly to the first variant of FIG. 11, an intermediate lens 328 is provided. In the present case it is placed optically between the second collector 316 and the main lens 310". Even more specifically, the intermediate lens 328 is placed in proximity to the second collector 316, and in any case at distance from the main lens 310", so as to scatter the second light beam not only toward the second entrance face 310".3 of the lens 310 but also towards the first entrance face 310".1. The diffuse second light beam 318 thus is superposed with the first beam 312, which in the present case is a lighting beam preferably containing a flat cut-off.

In light of these various embodiments and the variants thereof, it will be understood that various combinations of lighting and/or signaling light beams are possible in a given luminous device. In particular, the number of light sources and of corresponding collectors is not limited to two. Specifically, it is contemplated to provide more light sources and more corresponding collectors. As has already been highlighted with the embodiments described above, the various light beams produced by the various pairs of light sources and of collectors may be juxtaposed and/or superposed. In the variant of the third embodiment, in FIG. 12, the second beam produced by the light source and the collector located below the optical axis, said beam in the present case being diffuse, superposes, at least partially, with the first light beam. Furthermore, each of the first and second light sources, and optionally of the additional light sources, may be made up of a plurality of luminous regions that are activated upon at discretion and that emit light rays toward the corresponding collector.

Non-exhaustively, the following various combinations are possible in a given luminous device, in particular if a greater number of collectors and of light sources associated with said collectors are provided:

A first light beam taking the form of a first lighting beam containing a flat cut-off forming a portion of a first lighting function, a second light beam taking the form of a second lighting beam with a kinked cut-off forming another portion of the same first lighting function, and a third light beam taking the form of a third lighting beam with no cut-off forming all or some of a second lighting function.

For example, the first lighting beam may be a beam containing a flat cut-off forming a portion of a low-beam function, and the second lighting beam may be a beam with a kinked cut-off, forming a second portion of a low-beam function, the superposition of the first lighting beam and of the second lighting beam forming a low-beam function. The third lighting beam may form one portion of a high-beam function, called the complementary high-beam function and that forms a high-beam function when it is super-imposed with the first and second lighting beams.

Alternatively, the third light beam may be a third lighting beam taking the form of a luminous segment forming one portion of a second lighting function, and the luminous device emits a plurality of supplementary light beams taking the form of luminous segments forming one portion of this second lighting function, each of the luminous segments being selectively activated.

For example, the luminous segments formed by the third lighting beam forms one portion of a high-beam function and the superposition of all of the luminous segments formed by the third lighting beam and by the supplementary light beams with the first and second lighting beams forms a high-beam function.

In each of the above alternatives, the luminous device 2; 102; 202; 302 may also emit an additional light beam taking the form of a lighting or signaling beam.

A first light beam taking the form of a lighting beam without a cut-off forming a first lighting function, and a second light beam taking the form of a signaling beam forming a signaling function.

For example, the lighting beam may form a high-beam function and the signaling beam may form a signaling function chosen from among a direction-indicating function, a daytime-running-light function and a position-light function.

Alternatively, the first light beam may take the form of a first lighting beam containing a flat cut-off forming one portion of a first lighting function, and the device may emit a third light beam taking the form of a second lighting beam with a kinked cut-off forming another portion of the same first lighting function.

For example, the first lighting beam may be a beam containing a flat cut-off forming a portion of a low-beam function, and the second lighting beam may be a beam with a kinked cut-off, forming a second portion of a low-beam function, the superposition of the first lighting beam and of the second lighting beam forming a low-beam function.

The luminous device 2; 102; 202; 302 then emits a beam containing a flat cut-off, a beam containing a kinked cut-off and a signaling beam.

It is also possible, for each of the alternatives, for the luminous device 2; 102; 202; 302 to emit an additional light beam taking the form of a second signaling beam. For example, this second signaling beam may form a signaling function chosen from among a direction-indicating function, a daytime-running-light function and a position-light function.

In addition, the light sources on the one hand and the associated collectors on the other hand may be placed side-by-side. Alternatively, one portion of the light sources and their associated collectors may be opposite to the other portion of the light sources and their associated collectors, with respect to the optical axis.

According to one variant, provision may be made to have all of the collectors placed side-by-side.

For example, in its functional position, the luminous device may thus comprise a collector that participates in the formation of a lighting beam containing a flat cut-off, a collector that participates in the formation of a beam with a kinked cut-off and a collector that participates in the formation of a light beam forming one portion of a high-beam function, these collectors being placed side-by-side.

According to another variant, it is possible to have first and second light sources, associated with first and second collectors, respectively, that are opposite, with respect to the optical axis, to a third light source and to the third collector with which the third source is associated.

For example, in its functional position, the luminous device may comprise a first collector and a second collector that participate in the formation of a lighting beam containing a flat cut-off and of a beam with a kinked cut-off above the optical axis, respectively, and a third collector that participates in the formation of a light beam forming one portion of a high-beam function below the optical axis.

In another example, in its functional position, the luminous device may thus comprise a first collector and a second collector that participate in the formation of a lighting function and of a signaling function above the optical axis, respectively, and a third collector that participates in the formation of a light beam forming all or some of a signaling function below the optical axis.

According to another variant, it is possible to have a first light source associated with a first collector, both thereof being located opposite, with respect to the optical axis, to a second light source and to the second collector with which the second source is associated.

For example, in its functional position, the luminous device may thus comprise a first collector that participates in the formation of a lighting beam without cut-off forming a first lighting function above the optical axis, and a second collector that participates in the formation of a signaling beam below the optical axis.

What is claimed is:

1. A luminous device of a motor vehicle, comprising:

a lens;

a first light source and a second light source that are each able to emit light rays;

a first collector and a second collector each with a reflective surface configured to collect and reflect the light rays emitted by the first light source (4; 104; 204; 304) and the second light source, respectively;

an optical system configured to project the light rays reflected by the reflective surfaces of the first collector and of the second collector, respectively, into a first light beam and a second light beam along an optical axis of the luminous device;

characterized in that the first light beam is a lighting beam with or without an upper flat cut-off and the second beam is a signaling beam, the optical system has a first focal point located axially behind a front limit of the reflective surface of the first collector, the optical system has a second focal point located axially behind a front limit of the reflective surface of the second collector, the optical system further comprises a grained dioptric interface configured to scatter the second light beam, where the grained dioptric interface is formed on a second entrance face that is distinguished from a first entrance face, the lens is a main lens, the optical system further comprising an intermediate lens with the grained dioptric interface, said intermediate lens being placed optically between the reflective surface of the second collector and the main lens, the optical system is configured to form a luminous image of the reflective surface of each of the first collector and second collector, and each of the first light beam and the second light beam forms a portion or the entirety of a lighting or signaling function that is distinct from the lighting or signaling function of the other of said first and second beams.

2. The luminous device according to claim 1, characterized in that at least one of the first collector and second collector is configured so that the light rays reflected by a rear portion of the reflective surface of said collector are parallel to the optical axis (8; 108; 208; 308) or have, in a vertical plane with respect to said optical axis, an angle of inclination smaller than or equal to 25° or smaller than or equal to 10°.

3. The luminous device according to claim 1, characterized in that the first light source and second light source are configured to emit in a main direction that is perpendicular to the optical axis or that is inclined with respect to a direction perpendicular to said optical axis by an angle smaller than or equal to 25°, and the reflective surfaces of the first collector and second collector have an elliptical or parabolic profile.

4. The luminous device according to claim 1, characterized in that the optical system is a lens with the first entrance face for the light rays of the first light beam and the second entrance face for the light rays of the second light beam.

5. The luminous device according to claim 4, characterized in that the first and second entrance faces are aligned perpendicular to the optical axis.

6. The luminous device according to claim 4, characterized in that the lens has an exit face common to the first and second entrance faces.

7. The luminous device according to claim 1, characterized in that the first collector and the first light source are opposite, with respect to the optical axis, to the second collector and to the second light source, respectively; or the first collector and the first light source, on the one hand, and the second collector and the second light source, on the other hand, are placed side-by-side.

8. The luminous device according to claim 1, characterized in that the reflective surface of at least one of the first collector and second collector is concave and has, with respect to a general direction of propagation of the corresponding light beam, a front edge and a rear edge, said edges bounding in opposite directions the corresponding luminous image.

9. The luminous device according to claim 8, characterized in that the first collector and the first light source are located above the optical axis when the device is oriented in functional position, the first beam being a lighting beam containing an upper flat cut-off formed by the rear edge of the reflective surface of the first collector.

10. The luminous device according to claim 1, characterized in that said luminous device furthermore comprises a mirror configured to form a virtual image of at least one of the first and second light sources and of the reflective surface of the corresponding first collector or second collector, the optical system forming an image of said virtual image.

11. The luminous device according to claim 10, characterized in that the mirror lies in the extension of the reflective surface of the corresponding collector, or the mirror lies on the optical axis.

12. The luminous device according to claim 10, characterized in that the first collector and the first light source are located below the optical axis when the device is oriented in functional position, the first beam being a lighting beam containing an upper flat cut-off formed by the rear edge of the reflective surface of the first collector.

13. The luminous device according to claim 10, characterized in that the second collector and the second light source are located above the optical axis when the device is oriented in functional position, the second beam being a lighting beam with an upper portion without flat cut-off, formed by a front portion of the reflective surface of the second collector.

14. The luminous device according to claim 1, characterized in that the first light source and the second light source are placed on a common platen.

* * * * *